US008821048B2

(12) United States Patent
Imamura et al.

(10) Patent No.: US 8,821,048 B2
(45) Date of Patent: Sep. 2, 2014

(54) IMAGE RECORDING DEVICE WITH RECORDING MEDIUM TENSION CONTROL, AND IMAGE RECORDING METHOD WITH RECORDING MEDIUM TENSION CONTROL

(71) Applicant: Seiko Epson Corporation, Tokyo (JP)

(72) Inventors: Atsushi Imamura, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 13/670,946

(22) Filed: Nov. 7, 2012

(65) Prior Publication Data

US 2013/0112798 A1 May 9, 2013

(30) Foreign Application Priority Data

Nov. 8, 2011 (JP) ..... 2011-244276

(51) Int. Cl.

| | |
|---|---|
| ***B41J 29/38*** | (2006.01) |
| ***B41J 2/01*** | (2006.01) |
| ***B41J 15/16*** | (2006.01) |
| ***B65H 18/10*** | (2006.01) |
| ***B65H 23/192*** | (2006.01) |
| ***B65H 23/188*** | (2006.01) |

(52) U.S. Cl.

CPC ..... *B65H 23/1888* (2013.01); *B65H 2515/32* (2013.01); *B65H 2301/5111* (2013.01); *B65H 18/103* (2013.01); *B65H 23/192* (2013.01); *B65H 2404/147* (2013.01); *B65H 2515/31* (2013.01); *B65H 2301/41462* (2013.01); *B41J 15/165* (2013.01)

USPC ..... 400/76; 400/611; 400/613; 400/614; 400/618; 347/104

(58) Field of Classification Search

CPC . B65H 23/1888; B65H 23/1825; B41J 15/16; B41J 15/165

USPC ..... 400/614, 618

See application file for complete search history.

(56) References Cited

U.S. PATENT DOCUMENTS

| | | | | |
|---|---|---|---|---|
| 2008/0094443 | A1* | 4/2008 | Miyazaki | 347/19 |
| 2010/0188468 | A1* | 7/2010 | Herpel et al. | 347/101 |
| 2012/0069112 | A1* | 3/2012 | Wanibe | 347/104 |
| 2012/0201591 | A1* | 8/2012 | Leighton et al. | 400/618 |

FOREIGN PATENT DOCUMENTS

| | | | | |
|---|---|---|---|---|
| JP | 10052956 A | * | 2/1998 | B41J 15/16 |
| JP | 10-086472 A | | 4/1998 | |
| JP | 10086472 A | * | 4/1998 | B41J 15/04 |

* cited by examiner

*Primary Examiner* — Daniel J Colilla

(74) *Attorney, Agent, or Firm* — Global IP Counselors, LLP

(57) ABSTRACT

An image recording device includes: a conveyor unit for conveying a recording medium; a drum for rotating under force of friction against the recording medium being conveyed by the conveyor unit, the recording medium being wound around the drum; and a recording unit for recording an image onto a portion, wound around the drum, of the recording medium being conveyed by the conveyor unit; the conveyor unit starting the conveyance of the recording medium in a state where a first tension has been applied to the recording medium, but executing a switching operation for switching the tension applied to the recording medium after the conveyance of the recording medium has been started, to a second tension that is lower than the first tension.

15 Claims, 9 Drawing Sheets

IMAGE RECORDING DEVICE WITH RECORDING MEDIUM TENSION CONTROL, AND IMAGE RECORDING METHOD WITH RECORDING MEDIUM TENSION CONTROL

CROSS-REFERENCE TO RELATED APPLICATIONS

This application claims priority to Japanese Patent Application No. 2011-244276 filed on Nov. 8, 2011. The entire disclosure of Japanese Patent Application No. 2011-244276 is hereby incorporated herein by reference.

BACKGROUND

1. Technical Field

The present invention relates to a technology in which a recording medium is transported while being wound around a drum and the recording medium is thus supported by the drum, which rotates under the force of friction against the recording medium being conveyed.

2. Background Technology

Patent Citation 1 describes a recording device in which a continuous sheet of paper being conveyed from a paper conveying unit to a paper puller unit is wound around a conveying drum arranged between the paper conveying unit and the paper puller unit. With the continuous sheet of paper being wound therearound, the conveying drum is intended to thereby support the continuous sheet of paper while also rotating under the force of friction acting against the continuous sheet of paper being conveyed. In this recording device, also, a printing unit ejects ink to record an image on the portion of the continuous sheet of paper having been wound around the conveying drum.

Japanese Laid-open Patent Publication No. 10-086472 (Patent Document 1) is an example of the related art.

SUMMARY

Problems to be Solved by the Invention

With a configuration in which a drum around which a recording medium to be conveyed is wound is caused to rotate by the force of friction against the recording medium, when the force of friction against the recording medium is very small, then in some cases the rotation of the drum can not be promptly initiated at the start of the conveyance of the recording medium. In such a case, the rotation of the drum will not follow the conveyance of the recording medium, and as a consequence thereof, there is a possibility that the conveying speed of the recording medium can become unstable. At this time, it is difficult to appropriately record an image onto the recording medium of unstable conveying speed, and yet delaying the recording of the image until the conveying speed of the recording medium becomes stable results in the wasteful loss of conveying medium. In view whereof, there has been a desire to cause the rotation of the drum to initiate promptly at the start of the conveyance of the recording medium, and to curtail the period of time where the rotation of the drum has poor performance in terms of following the conveyance of the recording medium.

It is an advantage of the present invention, which has been contrived in view of the foregoing problems, to provide a technique for making it possible to cause the rotation of the drum to initiate promptly at the start of the conveyance of the recording medium, and to curtail the period of time where the rotation of the drum has poor performance in terms of following the conveyance of the recording medium.

Means Used to Solve the Above-Mentioned Problems

In order to achieve the foregoing advantage, the image recording device as in the present invention, includes: a conveyor unit for conveying a recording medium; a drum for rotating under force of friction against the recording medium being conveyed by the conveyor unit, the recording medium being wound around the drum; and a recording unit for recording an image onto a portion, wound around the drum, of the recording medium being conveyed by the conveyor unit; the image recording device being characterized in that the conveyor unit starts the conveyance of the recording medium in a state where a first tension has been applied to the recording medium, but executes a switching operation for switching the tension applied to the recording medium after the conveyance of the recording medium has been started, to a second tension that is lower than the first tension.

In order to achieve the foregoing advantage, the image recording method of the invention is an image recording method in which a recording medium to be conveyed is wound around a drum that rotates under force of friction against the recording medium, and an image is recorded onto a portion, wound around the drum, of the recording medium being conveyed, the image recording method being characterized in including: a step for starting the conveyance of the recording medium in a state where a first tension has been applied to the recording medium; and a step for switching the tension applied to the recording medium after the conveyance of the recording medium has been started, to a second tension that is lower than the first tension.

In the invention configured in this manner (the image recording device and image recording method), the conveyance of the recording medium is started in a state where the first tension is applied to the recording medium, and then the tension applied to the recording medium after the conveyance of the recording medium has started is switched to the second tension that is lower than the first tension. In other words, the higher first tension is applied to the recording medium at the start of the conveyance of the recording medium, and the tension applied after the start of the conveyance of the recording medium is switched to the lower second tension. Because the higher first tension is applied to the recording medium at the start of the conveyance of the recording medium, a considerable force of friction in accordance with the first tension acts on the recording medium and the drum. Accordingly, it becomes possible to cause the rotation of the drum to initiate promptly at the start of the conveyance of the recording medium, and to curtail the period of time where the rotation of the drum has poor performance in terms of following the conveyance of the recording medium.

Herein, the image recording device can be configured such that the conveyor unit accelerates the conveying speed of the recording medium during an acceleration period after the start of conveyance and thereafter maintains the conveying speed at a constant speed. However, with the configuration of such description, the acceleration of the rotation of the drum presumably will not adequately follow the acceleration of the conveyance of the recording medium during the acceleration period where the recording medium is accelerated.

This problem can possibly become especially significant in a case where during the course of the acceleration period, the tension applied to the recording medium is switched to the lower second tension. In view whereof, the image recording device can be configured such that the conveyor unit executes the switching operation such that the tension applied to the recording medium becomes the second tension after a point in time where the conveying speed of the recording medium has become a constant speed. This makes it possible to cause the acceleration of the rotation of the drum to follow the acceleration of the conveyance of the recording medium during the acceleration period where the recording medium is accelerated.

It also should be noted that the image recording device can be configured such that the conveyor unit executes the switching operation by reducing the tension applied to the recording medium from the first tension to the second tension. Herein, the image recording device can also be configured such that the conveyor unit starts the reduction of the tension applied to the recording medium, during the acceleration period. Alternatively, the image recording device can be configured such that the conveyor unit, during the acceleration period, maintains the tension applied to the recording medium at the first tension, and then starts the reduction of the tension applied to the recording medium after the point in time where the conveying speed of the recording medium has become a constant speed.

Also, with the configuration of such description, a variety of times can be conceived of for the timing whereby the recording unit starts the recording of the image. In view whereof, the image recording device can be configured such that the recording unit starts the recording of the image during the acceleration period. Alternatively, the image recording device can be configured such that the recording unit starts the recording of the image after the point in time where the conveying speed of the recording medium has become a constant speed. The image recording device could also be alternatively configured such that the recording unit starts the recording of the image after the point in time where the tension applied to the recording medium by the conveyor unit has become the second tension.

With the configuration of such description, it is also conceivable that each of the parts of the device would be controlled on the basis of the rotation of the drum. In view whereof, the image recording device can be configured so as to be further provided with a rotation detector for detecting the rotation of the drum.

In this regard, the image recording device can be configured such that the recording unit adjusts the timing for executing the recording of the image on the recording medium, on the basis of a detection result from the rotation detector. With this configuration where the timing of the execution of the recording of the image onto the recording medium is adjusted on the basis of the result of the detected rotation of the drum, the image cannot be accurately formed at a target position on the recording medium when the rotation of the drum has poor performance in terms of following the conveyance of the recording medium. For this reason, during the period where the drum has poor performance in terms of following the recording medium, a need can in some cases arise to place the recording of the image on the recording medium on standby. By contrast, with the present invention, because it is possible to successfully curtail the period where the drum has poor performance in terms of following the recording medium, it is possible also to curtail the standby period for the recording of the image onto the recording medium. As a result, the recording of the image onto the recording medium can be executed in a prompt manner.

The image recording device can also be configured such that the conveyor unit adjusts the timing where the tension being applied to the recording medium is switched to the second tension, on the basis of the detection result from the rotation detector. With the configuration of such description, the switching of the tension being applied to the recording medium to the second tension can be executed at a suitable timing while also the performance of the drum in terms of following the recording medium is being checked on the basis of the detection result from the rotation detector.

The switching operation described above can be configured so as to be executed in accordance with the type of the recording medium. For example, the image recording device can be configured such that the conveyor unit executes the switching operation in a case where the recording medium is film-based. Namely, a film-based recording medium has the property of being easily stretched by tension. Therefore, preferably, as has been described above, the period where the higher tension is being applied is restricted to being close to the start of the conveyance of the recording medium, and then after the start of conveyance, the tension being applied to the recording medium is kept low.

On the other hand, a paper-based recording medium is less stretched by tension. In view whereof, rather than restricting to being close to the start of the conveyance of the recording medium, the higher tension could be applied in a continuous manner. In view whereof, the image recording device can be configured such that in a case where the recording medium is paper-based, the conveyor unit starts the conveyance of the recording medium in a state where a third tension that is higher than the second tension is applied to the recording medium, and then does not carry out the switching operation even after the conveyance of the recording medium has been started, but rather maintains the tension being applied to the recording medium at the third tension. In the configuration of such description, too, because the higher third tension is applied to the recording medium at the start of conveyance of the recording medium, a considerable force of friction in accordance with the third tension will act on the recording medium and the drum. Accordingly, it becomes possible to cause the rotation of the drum to initiate promptly at the start of the conveyance of the recording medium, and to curtail the period of time where the rotation of the drum has poor performance in terms of following the conveyance of the recording medium.

The image recording device can also be configured such that the conveyor unit has a tension detector for detecting the tension of the recording medium, and adjusts the tension being applied to the recording medium in accordance with a detection result from the tension detector. Adopting a configuration in this manner makes it possible to precisely adjust the tension being applied to the recording medium.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
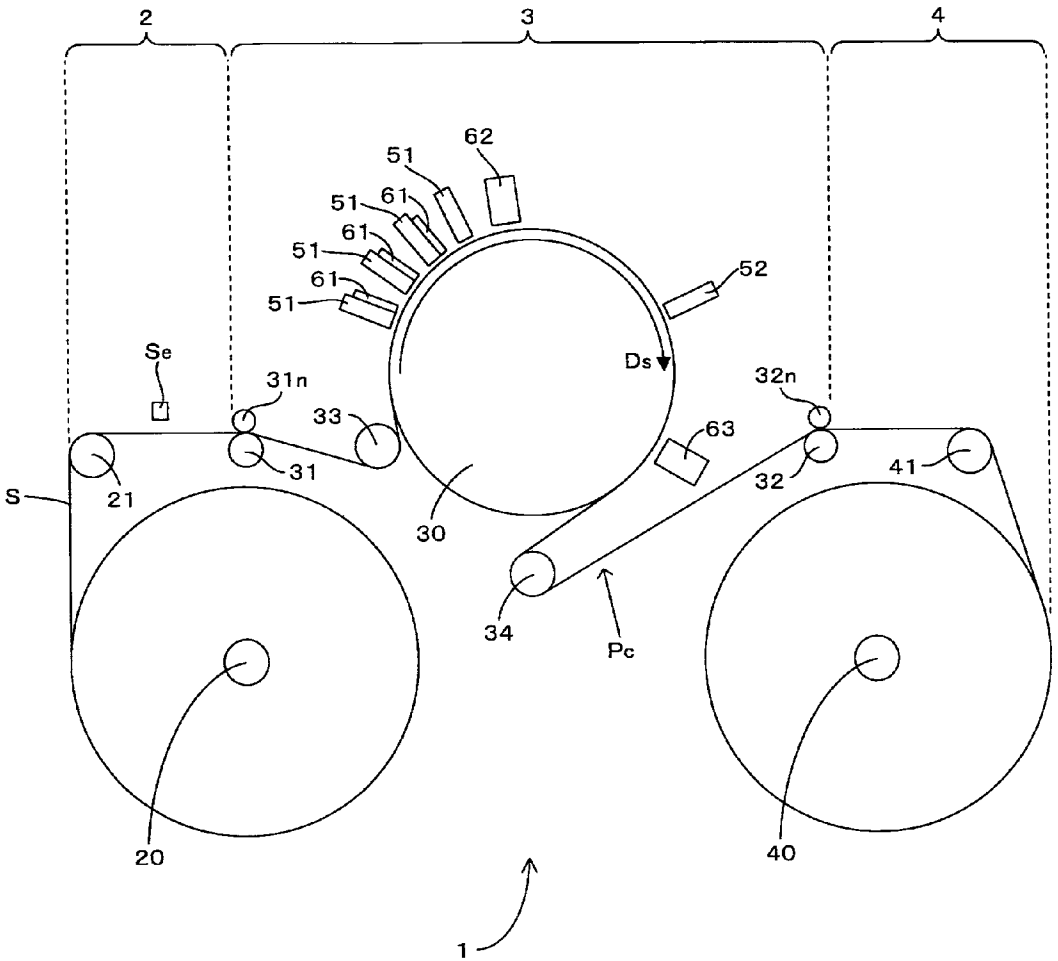
FIG. 1 is a drawing schematically illustrating an example of a device configuration provided to a printer to which the invention can be applied.

FIG. 1 is a plan view schematically illustrating an example of a configuration of a device configuration provided to a printer to which the invention can be applied. As illustrated in FIG. 1, in a printer 1, a single sheet S (web) having two ends that have been wound in a roll-shaped fashion around a supply spindle 20 and a take-up spindle 40 is stretched between the supply spindle 20 and the take-up spindle 40, and the sheet S is conveyed from the supply spindle 20 to the take-up spindle 40 along a path Pc having been thus stretched. In the printer 1, an image is recorded onto the sheet S being conveyed along the conveyance path Pc. The type of sheet S is largely divided into paper-based and film-based. As specific examples, paper-based includes high-quality paper, cast paper, art paper, coated paper, and the like, while film-based includes synthetic paper, PET (Polyethylene terephthalate), PP (polypropylene), and the like. In brief, the printer 1 is provided with: a supply unit 2 for supplying the sheet S from the supply spindle 20; a process unit 3 for recording an image onto the sheet S having been supplied from the supply unit 2; and a take-up unit 4 for taking up, around the take-up spindle 40, the sheet S on which the image has been recorded by the process unit 3. In the following description, whichever side of the two sides of the sheet S is the one on which the image is recorded is referred to as the "front surface", while the side opposite thereto is referred to as the "back surface".

The supply unit 2 has the supply spindle 20, around which an end of the sheet S has been wound, as well as a driven roller 21 around which is wound the sheet S having been drawn out from the supply spindle 20. The supply unit 20 supports the sheet S wound therearound in a state where the front surface of the sheet S faces outward. When the supply spindle 20 is rotated in the clockwise direction in FIG. 1, the sheet S having been wound around the supply spindle 20 is thereby made to pass through the driven roller 21 and supplied to the process unit 3. It should also be noted that the sheet S is wound about the supply spindle 20 with a core tube (not shown) therebetween, the core tube being removable with respect to the supply spindle 20. As such, when the sheet S on the supply spindle 20 has been exhausted, a new core tube around which a roll of the sheet S has been wound can be mounted onto the supply spindle 20, thus replacing the sheet S of the supply spindle 20.

The process unit 3 is intended to record an image onto the sheet S by carrying out a process, as appropriate, using functional units 51, 52, 61, 62, 63 arranged along the outer peripheral surface of a platen drum 30 while the platen drum 30 supports the sheet S having been supplied from the supply unit 2. In the process unit 3, a front drive roller 31 and a rear drive roller 32 are provided on two ends of the platen drum 30, and the sheet S, which is conveyed from the front drive roller 31 to the rear drive roller 32, is supported on the platen drum 30 and undergoes image recording.

The front drive roller 31 has on the outer peripheral surface a plurality of minute projections formed by thermal spraying, and the sheet S having been supplied from the supply unit 2 is wound around from the back surface side. Also, when the front drive roller 31 is rotated in the clockwise direction in FIG. 1, the sheet S having been supplied from the supply unit 2 is thereby conveyed downstream of the conveyance path. A nip roller 31*n* is provided to the front drive roller 31. The nip roller 31*n* is urged toward the front drive roller 31 side and in this state abuts against the front surface of the sheet S, and sandwiches the sheet S with the front drive roller 31 on the other side. This ensures the force of friction between the front drive roller 31 and the sheet S, and makes it possible for the front drive roller 31 to reliably convey the sheet S.

The platen drum 30 is a cylindrically-shaped drum rotatably supported by a support mechanism (not shown), and the sheet S being conveyed from the front drive roller 31 to the rear drive roller 32 is wound therearound from the back surface side. The platen drum 30 is intended to support the sheet S from the back surface side while also reciprocatingly rotating in a conveyance direction Ds of the sheet S, under the force of friction against the sheet S. It should also be noted that in the process unit 3, driven rollers 33, 34 for folding the sheet S on both sides of a section wound around the platen drum 30 are provided. Of these, the driven roller 33 folds the sheet S with the front surface of the sheet S wound between the front drive roller 31 and the platen drum 30. On the other hand, the driven roller 34 folds the sheet S with the front surface of the sheet S wound between the platen drum 30 and the rear drive roller 32. In this manner, the sheet S is folded upstream and downstream of the platen drum 30 in the conveyance direction Ds, whereby the length of the wound section of the sheet S on the platen drum 30 can be ensured.

The rear drive roller 32 has on the outer peripheral surface a plurality of minute projections formed by thermal spraying, and the sheet S having been conveyed from the platen drum 3 via the driven roller 34 is wound around from the back surface side. When the rear drive roller 32 is rotated in the clockwise direction in FIG. 1, the sheet S is thereby conveyed toward the take-up unit 4. A nip roller 32*n* is provided to the rear drive roller 32. This nip roller 32 is urged toward the rear drive roller 32 and in this state abuts against the front surface of the sheet S, and sandwiches the sheet S with the rear drive roller 32 on the other side. This ensures the force of friction between the rear drive roller 32 and the sheet S, and makes it possible for the rear drive roller 32 to reliably convey the sheet S.

In this manner, the sheet S being conveyed from the front drive roller 31 to the rear drive roller 32 is supported on the outer peripheral surface of the platen drum 30. Also, with the process unit 3, in order to record a color image onto the front surface of the sheet S being supported on the platen drum 30, a plurality of recording heads 51 corresponding to mutually different colors are provided. Specifically, four recording heads 51 corresponding to yellow, cyan, magenta, and black are lined up in the stated order of colors in the conveyance direction Ds. Each of the recording heads 51 faces the front surface of the sheet S wound around the platen drum 30, with a certain amount of clearance therebetween, and ejects ink of the corresponding color in an ink jet scheme. When each of the recording heads 51 ejects ink onto the sheet S being conveyed toward the conveyance direction Ds, a color image is thereby formed on the front surface of the sheet S.

It should also be noted that the ink used is UV (ultraviolet) ink (photo-curable ink) that is cured by being irradiated with ultraviolet rays (light). In view whereof, with the process unit 3, in order to cure the ink and affix same to the sheet S, UV lamps 61, 62 (light irradiation units) are provided. The execution of this curing of the ink is divided into two stages, which are temporary curing and true curing. A UV lamp 61 for temporary curing is arranged between each of the plurality of recording heads 51. Namely, the UV lamp 61 is intended to irradiate with weak ultraviolet rays and thereby cure the ink to such an extent that the shape of the ink is not lost (temporary curing), and is not intended to fully cure the ink. On the other hand, a UV lamp 62 for true curing is provided downstream in the conveyance direction Ds with respect to each of the plurality of recording heads 51. Namely, the UV lamp 62 irradiates with stronger ultraviolet rays than the UV lamp 61 and is intended to thereby fully cure the ink (true curing). Executing the temporary curing and true curing in this manner makes it possible to affix onto the front surface of the sheet S the color image formed by the plurality of recording heads 51.

Also, a recording head 52 is provided downstream in the conveyance direction Ds with respect to the UV lamp 62. This recording head 52 faces the front surface of the sheet S wound around the platen drum 30, with a certain amount of clearance therebetween, and ejects a transparent UV ink onto the front surface of the sheet S in an ink jet scheme. In other words, transparent ink is additionally ejected onto the color image formed by the recording heads 51 of the four different colors. A UV lamp 63 is also provided downstream in the conveyance direction Ds with respect to the recording head 52. This UV lamp 63 irradiates with strong ultraviolet rays and is intended to thereby fully cure (true curing) the transparent ink having been ejected by the recording head 52. This makes it possible to affix the transparent ink onto the front surface of the sheet S.

With the process unit 3, this manner of ejecting and curing ink is executed as appropriate on the sheet S wound about the outer peripheral part of the platen drum 30, and a color image coated with the transparent ink is formed. Also, the sheet S on which the color image has been formed is conveyed toward the take-up unit 4 by the rear drive roller 32.

In addition to the take-up spindle 40 around which an end of the sheet S is wound, the take-up unit 4 also has a driven roller 41 around which the sheet S is wound from the back surface side between the take-up spindle 40 and the rear drive roller 32. The take-up spindle 40 supports one end of the sheet S taken up therearound in a state where the front surface of the sheet S is facing outward. Namely, when the take-up spindle 40 is rotated in the clockwise direction in FIG. 1, the sheet S, which has been conveyed from the rear drive roller 32, passes through the driven roller 41 and is taken up around the take-up spindle 40. It also should be noted that the sheet S is taken up around the take-up spindle 40 with a core tube (not shown) therebetween, the core tube being detachable with respect to the take-up spindle 40. As such, when the sheet S taken up around the take-up spindle 40 has been exhausted, it becomes possible to remove the sheet S together with the core tube.

Figure 2:
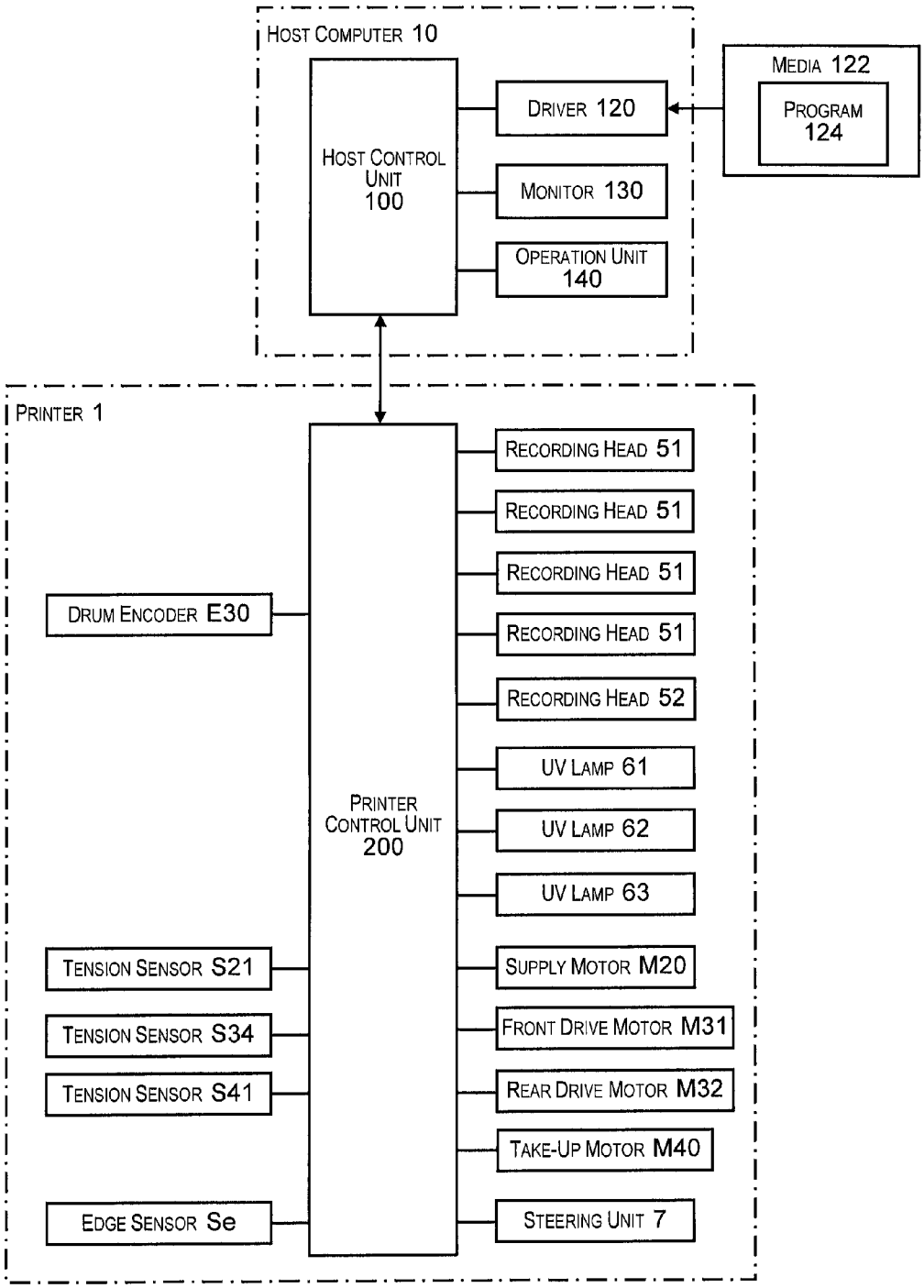
FIG. 2 is a drawing schematically illustrating an electrical configuration for controlling the printer illustrated in FIG. 1.

The foregoing is a summary of the device configuration of the printer 1. The following description shall relate to the electrical configuration for controlling the printer 1. FIG. 2 is a block diagram schematically illustrating the electrical configuration for controlling the printer illustrated in FIG. 1. The operation of the printer 1 described above is controlled by a host computer 10 illustrated in FIG. 2. With the host computer 10, a host control unit 100 for governing all control operations is constituted of a CPU (Central Processing Unit) and a memory. A driver 120 is also provided to the host computer 10, and this driver 120 reads out a program 124 from media 122. The media 122 can be a variety of different things, such as a CD (Compact Disk), DVD (Digital Versatile Disk), or USB (Universal Serial Bus) memory. The host control unit 100 also controls each of the parts of the host computer 10 and controls the operation of the printer 1, on the basis of the program 124 having been read out from the media 122.

As interfaces for interfacing with an operator, a monitor 130 constituted of a liquid crystal display or the like and an operation unit 140 constituted of a keyboard, mouse, or the like are provided to the host computer 10. In addition to an image to be printed, a menu screen is also displayed on the monitor 130. As such, by operating the operation unit 140 while also checking the monitor 130, the operator is able to open up a print setting screen from the menu screen and set the type of printing medium, the size of printing medium, the quality of printing, and a variety of other print conditions. A variety of modifications could be made to the specific configuration of the interface for interfacing with the operator; for example, a touch panel-type display can be used as the monitor 130, the operation unit 140 being then constituted of the touch panel of this monitor 130.

On the other hand, in the printer 1, a printer control unit 200 for controlling each of the parts of the printer 1 in accordance with a command from the host computer 10 is also provided. The recording heads, the UV lamps, and each of the device parts in the sheet conveyance system are controlled by the printer control unit 200. The details of the manner in which the printer control unit 200 controls each of the device parts are as follows.

The printer control unit 200 control the ink ejection timing of each of the recording heads 51 for forming the color image, in accordance with the conveyance of the sheet S. More specifically, the control of the ink ejection timing is executed on the basis of an output (detection value) from a drum encoder E30 for detecting the rotational position of the platen drum 30, the drum encoder E30 being mounted onto a rotating shaft of the platen drum 30. Namely, because the platen drum 30 rotates reciprocatingly in association with the conveyance of the sheet S, the conveyance position of the sheet S can be ascertained when the output of the drum encoder E30 for detecting the rotational position of the platen drum 30 is referenced. In view thereof, the printer control unit 200 generates a pts (print timing signal) signal from the output of the drum encoder E30 and controls the ink ejection timing of each of recording heads 51 on the basis of the pts signal, whereby the ink having been ejected by each of the recording heads 51 is impacted onto a target position on the sheet S that is being conveyed, thus forming the color image.

The timing whereby the recording head 52 ejects the transparent ink, too, is controlled by the printer control unit 200 in a similar fashion on the basis of the output of the drum encoder E30. This makes it possible for the transparent ink to be accurately ejected onto the color image having been formed by the plurality of recording heads 51. The irradiation light intensity and timing of the turning on and off of the UV lamps 61, 62, 63 are also controlled by the printer control unit 200.

The printer control unit 200 also governs a function for controlling the conveyance of the sheet S, as described in detail with reference to FIG. 1. Namely, among the members constituting the sheet conveyance system, a motor is respectively connected to the supply spindle 20, the front drive roller 31, the rear drive roller 32, and the take-up spindle 40. The printer control unit 200 controls the speed and torque of each of the motors while causing the motors to rotate, and thus controls the conveyance of the sheet S. The details of this control of the conveyance of the sheet S are as follows.

The printer control unit 200 causes a supply motor M20 for driving the supply spindle 20 to rotate, and feeds the sheet S from the supply spindle 20 to the front drive roller 31. The printer control unit 200 herein controls the torque of the supply motor M20 to adjust the tension (supply tension Ta) from the supply spindle 20 to the front drive roller 31.

Namely, a tension sensor S21 for detecting the supply tension Ta is mounted onto the driven roller 21 arranged between the supply spindle 20 and the front drive roller 31. The tension sensor S21 can be constituted of, for example, a load cell for detecting the force received from the sheet S. The printer control unit 200 carries out a feedback control of the torque of the supply motor M20 on the basis of a detection result from the tension sensor S21, and thus adjusts the supply tension Ta of the sheet S.

The printer control unit 200 herein carries out the supply of the sheet S while also adjusting the position of the sheet S, in the width direction (the direction orthogonal to the paper in FIG. 1), being fed out from the supply spindle 20 to the front drive roller 31. Namely, a steering unit 7 for respectively displacing the supply spindle 20 and the driven roller 21 in the axial direction (in other words, the width direction of the sheet S) is provided to the printer 1. An edge sensor Se for detecting an edge of the sheet S in the width direction is arranged between the drive roller 21 and the front drive roller 31. The edge sensor Se can be constituted of a distance sensor such as, for example, an ultrasonic sensor. The printer control unit 200 also carries out feedback control of the steering unit 7 on the basis of a detection result from the edge sensor Se, and thus adjusts the position of the sheet S in the width direction. The position of the sheet S in the width direction is thereby suitably adapted, and meandering or other instances of poor conveyance of the sheet S is thereby suppressed.

The printer control unit 200 also rotates a front drive motor M31 for driving the front drive roller 31, and a rear drive motor M32 for driving the rear drive roller 32. The sheet S having been supplied from the supply unit 2 is thereby passed through the process unit 3. Herein, speed control is executed for the front drive motor M31, whereas torque control is executed for the rear drive motor M32. In other words, the printer control unit 200 adjusts the rotation of the front drive motor M31 to a constant speed, on the basis of an encoder output from the front drive motor M31. The sheet S is thereby conveyed at a constant speed by the front drive roller 31.

On the other hand, the printer control unit 200 controls the torque of the rear drive motor M32 and thus adjusts the tension (process tension Tb) of the sheet S from the front drive roller 31 to the rear drive roller 32. Namely, a tension sensor S34 for detecting the process tension Tb is mounted onto the drive roller 34 arranged between the platen drum 30 and the rear drive roller 32. This tension sensor S34 can be constituted, for example, of a load cell for detecting the force received from the sheet S. The printer control unit 200 also carries out feedback control of the torque of the rear drive motor M32 on the basis of a detection result from the tension sensor S34, and thus adjusts the process tension Tb of the sheet S.

The printer control unit 200 causes a take-up motor M40 for driving the take-up spindle 40 to rotate, and the sheet S conveyed by the rear drive roller 32 is taken up around the take-up spindle. Herein, the printer control unit 200 controls the torque of the take-up motor M40 and thus adjusts the tension (take-up tension Tc) of the sheet S from the rear drive roller 32 to the take-up spindle 40. Namely, a tension sensor S41 for detecting the take-up tension Tc is mounted onto the drive roller 41 arranged between the rear drive roller 32 and the take-up spindle 40. This tension sensor S41 can be constituted, for example, of a load cell for detecting the force received from the sheet S. The printer control unit 200 carries out a feedback control of the torque of the take-up motor M40 on the basis of a detection result from the tension sensor S41, and thus adjusts the take-up tension Tc of the sheet S.

The foregoing is a summary of the electrical configuration for controlling the printer 1. As described above, with the printer 1, the platen drum 30 supports the sheet S while also rotating reciprocatingly in the conveyance direction Ds of the sheet S, under the force of friction against the sheet S. However, with the configuration of such description, there are some cases where the rotation of the platen drum 30 has not initiated promptly at the start of conveyance of the sheet S. The reason for this is that between the sheet S and the platen drum 30, there has not been ensured a force of friction commensurate with a force that surpasses the force of Coulomb friction acting between the platen drum 30 and the support mechanism thereof, and the inertia of the platen drum 30, and causes the platen drum 30 to rotate steadily. By contrast, with the first embodiment, starting the conveyance of the sheet S from a state where a pre-tension F1 has been applied to the sheet S of the process unit 3 achieves a prompt initiation of the rotation of the platen drum 30. The following is a more detailed description of the operation therefor.

Figure 3:
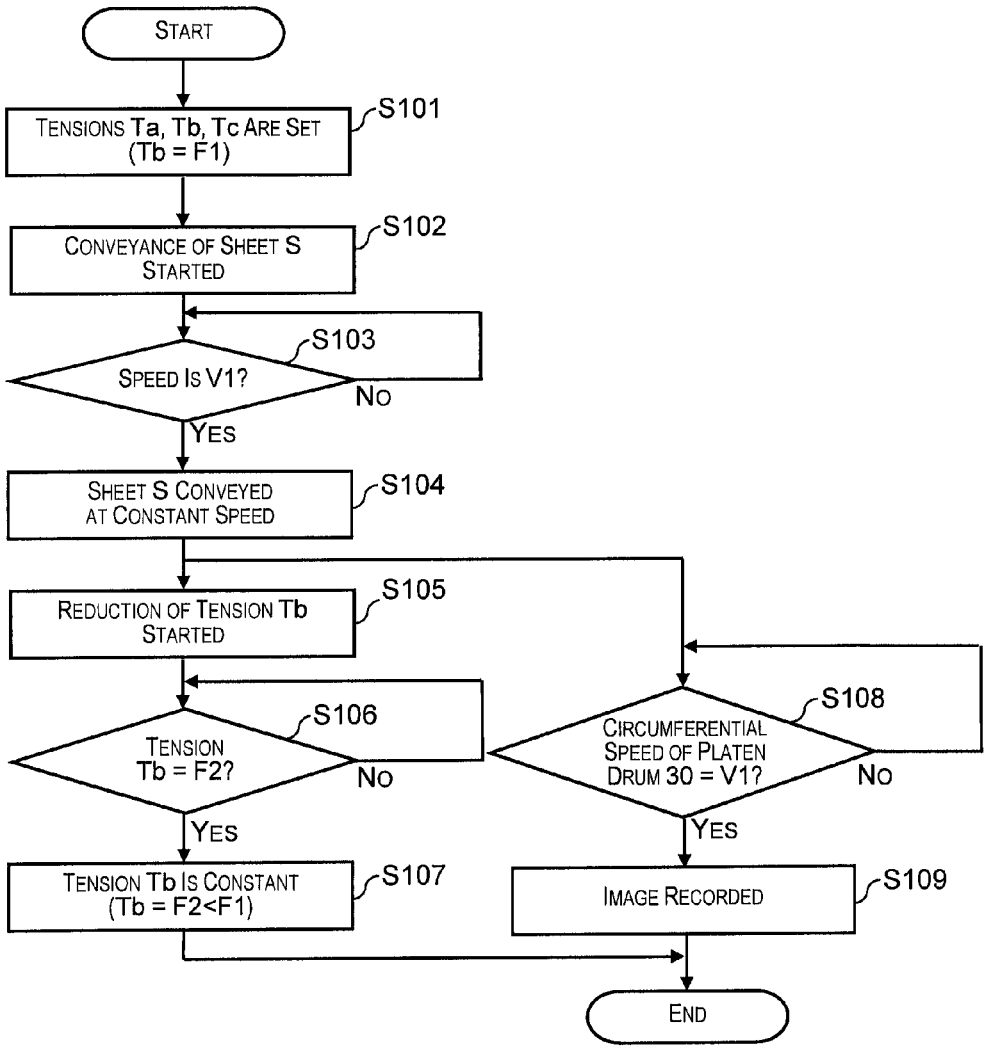
FIG. 3 is a flow chart illustrating an operation executed by a printer of a first embodiment.
Figure 4:
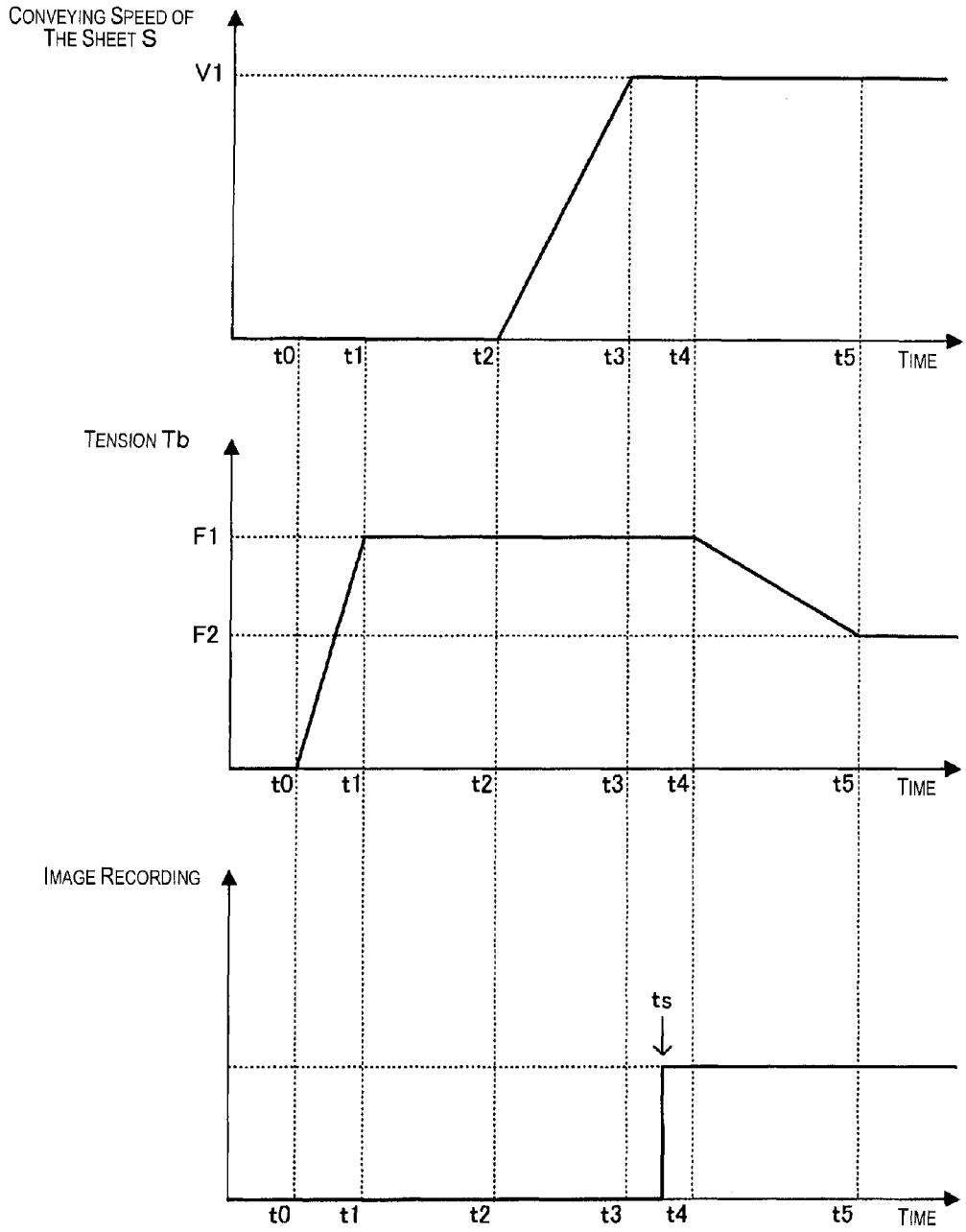
FIG. 4 is a timing chart illustrating an operation executed by the printer of the first embodiment.

FIG. 3 is a flow chart illustrating a summary of an operation executed by the printer as in the first embodiment. FIG. 4 is a timing chart illustrating a summary of an operation executed by the printer as in the first embodiment. When a command indicating that image recording is to be started is received from the host computer 10, the printer control unit 200 executes the flow chart in FIG. 3. The flow chart is read out from the program 124, and is stored in advance in a memory inside the printer control unit 200 or elsewhere.

In a step S101, the torques of the supply motor M20, the rear drive motor M32, and the take-up motor M40 are adjusted, and the respective tensions Ta, Tb, Tc of the sheet S in the supply unit 2, the process unit 3, and the take-up unit 4 are set to initial values. Especially in the present embodiment, the tension Tb of the process unit 3 is set to a comparatively high plate tension F1. As illustrated in FIG. 4, the setting of the pre-tension F1 is executed by increasing the tension from "zero" to "F1" over a predetermined period of time (=t1−t0). The higher pre-tension F1 is thereby made to suddenly act on the sheet S, whereby the occurrence of a defect such as where the sheet S moves considerably and interferes with another function unit or tears is suppressed. /0}In the step S101, the front drive motor M31 does not operate, and the sheet S is stopped.

Subsequently, in a step S102, the front drive motor M31 operates, whereby the front drive roller 31 starts to rotate and the conveyance of the sheet S is started. The conveying speed of the sheet S is thereby accelerated (at a point in time t2 to t3 in FIG. 4). When the higher pre-tension F1 is applied to the sheet S of the process unit 3, the higher tension is thereby applied to the wound portion of the sheet S around the platen drum 30. For this reason, at the start of conveyance of the sheet S, a considerable force of friction acts between the sheet S and the platen drum 30. As such, it becomes possibly to promptly initiate the rotation of the platen drum 30 at the start of conveyance of the sheet S. The rotation of the platen drum 30 is thus accelerated in association with the acceleration of the conveying speed of the sheet S. Over an acceleration period (a point in time t2 to t3) of the conveying speed of the sheet S, the tension Tb being applied to the sheet S is maintained at the pre-tension F1.

In a step S103, a determination is made as to whether or not the conveying speed of the sheet S has reached a speed V1. Specifically, the circumferential speed of the front drive roller 31, which is calculated from the encoder output of the front drive motor M31, is found as the conveying speed of the sheet S, and this conveying speed is compared against the speed V1, to execute the determination in the step S103. When the conveying speed of the sheet S has reached the speed V1 (a case of "YES" for the step S103), the flow proceeds to a step S104, in which the conveying speed of the sheet S is fixed to the speed V1 and the sheet S is conveyed at constant speed (a point in time t3 in FIG. 4, onward).

When the conveying speed of the sheet S has reached the speed V1 and becomes a constant speed, a reduction in the tension Tb of the sheet S at the process unit 3 is started in a step S105. Specifically, the reduction of the tension Tb is started at a point in time t4, which is a wait of a predetermined period of time from the point in time t3 where the conveying speed of the sheet S has become the speed V1. In a step S106, a determination is made as to whether or not the tension Tb has been reduced to a tension F2 (<F1). When the tension Tb has been reduced to the tension F2 (a case of "YES" in the step S106), the flow proceeds to a step S107, in which the tension Tb is fixed to the tension F2 and is kept constant. In this manner, in the present embodiment, the steps S105 to S107 are executed and a switching operation for switching the tension Tb of the sheet S to the tension F2 is executed.

When in step S104 the conveying speed of the sheet S has become a constant speed, steps S108, S109 are executed in parallel with the switching operation for the tension Tb in the above-described steps S105 to S107. In the step S108, a determination is made as to whether or not the circumferential speed of the platen drum 30 matches the conveying speed of the sheet S (=V1). Specifically, there is determined to be a match when the difference between the conveying speed (=V1) and the circumferential speed of the platen drum, as calculated from the output of the drum encoder E30 of the platen drum 30, is not greater than a predetermined threshold value. When the circumferential speed of the platen drum 30 matches the conveying speed (=V1), then an image recording of a step S109 is executed (a point in time is in FIG. 4). This image recording is carried out by the ejection of ink from each of the recording heads 51 at a timing in accordance with the pts signal, as described above.

As in the description above, in the present embodiment, the conveyance of the sheet S is started in a state where the pre-tension F1 is applied to the sheet S, but the tension Tb applied to the sheet S after the conveyance of the sheet S has started is then switched to the tension F2 that is lower than the pre-tension F1. In other words, the higher pre-tension F1 is applied to the sheet S at the start of the conveyance of the sheet S, and the tension Tb applied to the sheet S after the start of the conveyance of the sheet S is then switched to the lower tension F2. In this manner, because the higher pre-tension F1 is applied to the sheet S at the start of the conveyance of the sheet S, a considerable force of friction in accordance with the pre-tension F1 acts between the sheet S and the platen drum 30. Accordingly, it becomes possible to cause the rotation of the platen drum 30 to initiate promptly at the start of the conveyance of the sheet S, and to curtail the period of time where the rotation of the platen drum 30 has poor performance in terms of following the conveyance of the sheet S.

It should also be noted that in the present embodiment, the tension Tb applied to the sheet S is adjusted in accordance with the detection result from the tension sensor S34 for detecting the tension Tb of the sheet S. As such, it becomes possible to precisely adjust the tension Tb applied to the sheet S.

Also, in the present embodiment, the conveying speed of the sheet S is maintained at a constant speed after having been accelerated during the acceleration period (the points in time t2 to t3) following the start of conveyance. However, with the configuration of such description, the acceleration of the rotation of the platen drum 30 can conceivably be unable to adequately follow the acceleration of the conveyance of the sheet S during the acceleration period where the sheet S is accelerated. This problem can possibly become especially significant in a case where during the course of the acceleration period, the tension Tb applied to the sheet S is switched to the lower tension F2. By contrast, in the present embodiment, the switching operation is executed such that the tension Tb applied to the sheet S becomes the tension F2 after the point in time t3 where the conveying speed of the sheet S has become a constant speed. This makes it possible to cause the acceleration of the rotation of the platen drum 30 to follow the acceleration of the conveyance of the sheet S during the acceleration period where the sheet S is accelerated.

Also, in the present embodiment, the drum encoder E30 for detecting the rotation of the platen drum 30 is provided in order to control each of the parts of the printer 1 on the basis of the rotation of the platen drum 30. The timing whereby the recording of the image onto the sheet S is executed is also adjusted on the basis of the detection result from the drum encoder E30. In the configuration of such description, the image cannot be formed correctly at the target position on the sheet S when the rotation of the platen drum 30 has poor performance in terms of following the conveyance of the sheet S. For this reason, during the period of time where the platen drum 30 has poor performance in terms of following the sheet S, it has in some cases been necessary to put the recording of the image onto the sheet S on standby. By contrast, in the present embodiment, because the period of time where the platen drum has poor performance in terms of following the sheet S has successfully been curtailed, it becomes possible also to curtail the standby period for the recording of the image onto the sheet S. As a result, the recording of the image onto the sheet S can be executed in a prompt manner.

In particular with a configuration where, as in the present embodiment, the image recording is started after the circumferential speed of the platen drum 30 is matched to the conveying speed of the sheet S (=V1), then the image recording will not be executed during the period of time where the rotation of the platen drum 30 has poor performance in terms of following the conveyance of the sheet S (herein, the period of time where the circumferential speed of the platen drum 30 does not match the conveying speed of the sheet S (=V1). As such, there will be wasteful loss of the sheet S of which the wound section about the platen drum 30 has passed through during this period of time, and this will become so-called spoiled paper. By contrast, in the present embodiment, because this period of time has been curtailed, it becomes possible to suppress the amount of spoiled paper (FIG. 5).

Figure 5:
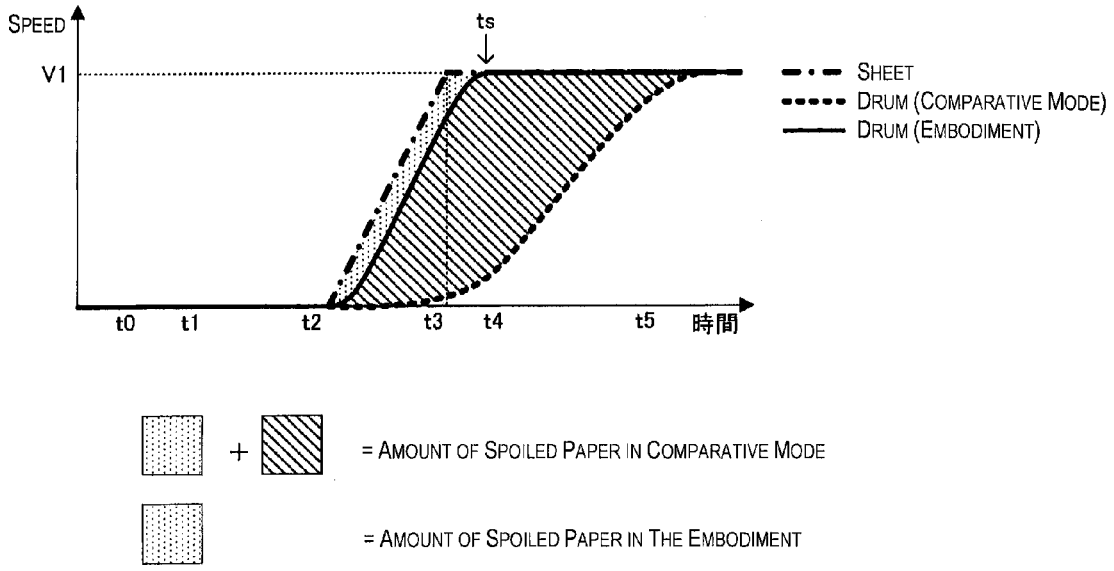
FIG. 5 is a descriptive drawing for describing the amount of spoiled paper.

Herein, FIG. 5 is a descriptive drawing for describing the amount of spoiled paper. The dash-dotted line in FIG. 5 illustrates the conveying speed of the sheet S. The dashed line in FIG. 5 illustrates the circumferential speed of the platen drum 30 in a comparative mode where the tension F2 is applied beginning with the start of conveyance of the sheet S, without the pre-tension F1 being applied. The solid line in FIG. 5 illustrates the circumferential speed of the platen drum 30 in the embodiment. Also, the sum total of the surface area of the dot hatching portion and the surface area of the slanted hatching portion is equivalent to the amount of spoiled paper in the comparative mode, and the surface area of the dot hatching portion corresponds to the amount of spoiled paper in the embodiment.

Firstly, consideration will be giving to the respective behaviors in the comparative mode and the embodiment in the vicinity of t2, the start of the conveyance of the sheet S. At t2, the start of conveyance of the sheet S, a greater force of static friction (in comparison to the force of dynamic friction) acts as a force of Coulomb friction on the platen drum 30. As such, in order for the rotation of the platen drum 30 to be initiated from the stationary state, it is necessary to overcome not only the inertia of the platen drum 30 but also the considerable force of static friction, and it is necessary to cause considerable torque to act on the platen drum 30. However, in the comparative mode where the pre-tension F1 is not applied, the force of friction between the platen drum 30 and the sheet S is low, and an adequate torque cannot be applied to the platen drum 30. As a result, even at the start of conveyance of the sheet S, the rotation of the platen drum 30 is not readily initiated. By contrast, in the embodiment, because the pre-tension F1 is applied to the sheet S, it becomes possible to adequately ensure the force of friction between the platen drum 30 and the sheet S, and to apply a considerable torque to the platen drum 30. As a result, when the conveyance of the sheet S is started at the point in time t2, the rotation of the platen drum 30 is promptly initiated.

The change in the circumferential speed of the platen drum 30 after the rotation of the platen drum 30 has been initiated is also considerably different between the comparative mode and the embodiment. In other words, in the comparative mode where the pre-tension F1 is not applied, the slope of the circumferential speed of the platen drum 30 is much smaller with respect to the slope of the conveying speed of the sheet S during the acceleration period, and the acceleration of the platen drum 30 does not adequately follow the acceleration of the sheet S. On the other hand, in the present embodiment, the pre-tension F1 is applied to the sheet S throughout the acceleration period of the sheet S. As a result, the slope of the conveying speed of the sheet S and the slope of the circumferential speed of the platen drum 30 are substantially matched during the acceleration period, and the acceleration of the drum 30 steadily follows the acceleration of the sheet S. For this reason, in the embodiment, the matching of the conveying speed (=V1) of the sheet S and the circumferential speed of the platen drum 30 can be implemented earlier in comparison to the modification mode, and the image recording can be started more promptly and the amount of spoiled paper can be better kept low.

Second Embodiment

In the first embodiment, the reduction of the tension Tb of the sheet S was started after the constant-speed conveyance of the sheet S had started. However, the timing for starting the reduction of the tension Tb of the sheet S is not limited thereto; the timing can also be as is illustrated below in the second embodiment. The point of different in the second embodiment from the first embodiment is primarily the timing for the start of the reduction of the tension Tb, and thus the description below shall center on this different portion; a description of like portions shall be omitted as appropriate. It shall be readily understood that the second embodiment, too, being equipped with a configuration akin to that of the first embodiment, thereby gives rise to an effect similar to that of the first embodiment.

Figure 6:
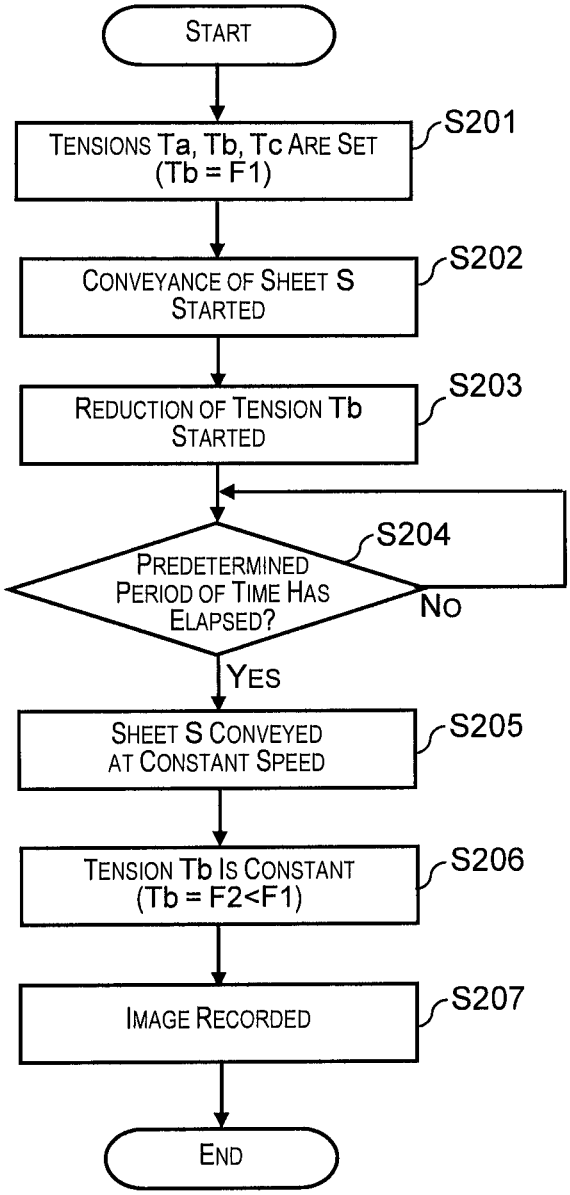
FIG. 6 is a flow chart illustrating an operation executed by a printer of a second embodiment.
Figure 7:
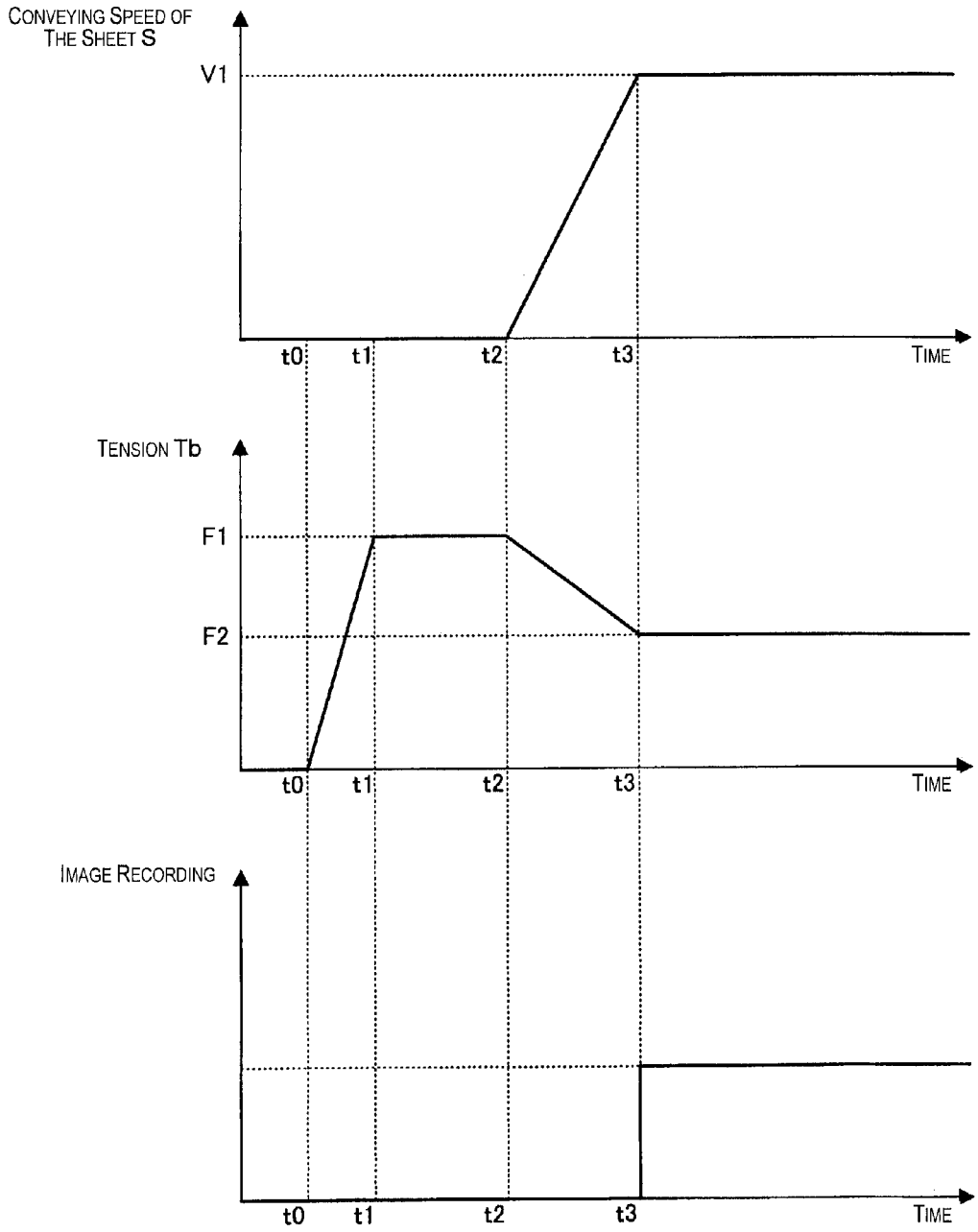
FIG. 7 is a timing chart illustrating an operation executed by the printer of the second embodiment.

FIG. 6 is a flow chart illustrating a summary of an operation executed by a printer as in the second embodiment. FIG. 7 is a timing chart illustrating a summary of an operation executed by the printer as in the second embodiment. When a command indicating that image recording is to be started is received from the host computer 10, the printer control unit 200 executes the flow chart in FIG. 6. The flow chart is read out from the program 124, and is stored in advance in a memory inside the printer control unit 200 or elsewhere.

In a step S201, the torques of the supply motor M20, the rear drive motor M32, and the take-up motor M40 are adjusted, and the respective tensions Ta, Tb, Tc of the sheet S at the supply unit 2, the process unit 3, and the take-up unit 4 are set to initial values. Also, in the present embodiment, too, the tension Tb of the process unit 3 is set to the pre-tension F1 over a predetermined period of time (=t1−t0). In the subsequent step S202, the front drive motor M31 is operated, whereby the front drive roller 31 starts to rotate and the conveyance of the sheet S is started. The conveying speed of the sheet S is thereby accelerated (points in time t2 to t3 in FIG. 7). Also, in the present embodiment, the reduction of the tension Tb of the sheet S is started at the point in time t2 where the front drive roller 31 starts to rotate (a step S203).

In a subsequent step S204, a determination is made as to whether or not a predetermined period of time (=t3−t2) has elapsed. The degree of acceleration of the conveyance of the sheet S is herein set so that the conveying speed of the sheet S reaches the speed V1 from zero in a predetermined period of time (=t3−t2). The rate of change of the tension Tb of the sheet S is set so that the tension Tb of the sheet S is reduced from the pre-tension F1 to the tension F2 in a predetermined period of time (=t3−t2). As such, at the point in time t3 where the predetermined period of time (=t3−t2) has elapsed, the conveying speed of the sheet S will have reached the speed V1, and the tension Tb of the sheet S will have reached the tension F2.

Also, when the predetermined period of time (=t3−t2) has elapsed (a case of "YES" in the step S204), the conveying speed of the sheet S is fixed to the speed V1, and the sheet S is conveyed at constant speed (a step S205). The tension Tb of the sheet S is fixed to the tension F2, and is kept constant (a step S206). In the state where the conveying speed and tension Tb of the sheet S have been set in this manner, the recording of the image is executed (a step S207).

As in the foregoing description, in the present embodiment, too, the conveyance of the sheet S is started in a state where the higher pre-tension F1 has been applied to the sheet S, but the tension Tb to be applied to the sheet S after the conveyance of the sheet S has been started is switched to the lower tension F2. In this manner, because the higher pre-tension F1 is applied to the sheet S at the start of the conveyance of the sheet S, a considerable force of friction in accordance with the pre-tension F1 acts between the sheet S and the platen drum 30. Accordingly, it becomes possible to cause the rotation of the drum 30 to initiate promptly at the start of the conveyance of the sheet S, and to curtail the period of time where the rotation of the drum 30 has poor performance in terms of following the conveyance of the sheet S.

Also, in the present embodiment as well, the switching operation is executed such that the tension Tb being applied to the sheet S will be the tension F2 at the point in time t3, where the conveying speed of the sheet S has reached a constant speed, and thereinafter. This makes it possible for the acceleration of the rotation of the platen drum 30 to be made to follow the acceleration of the conveyance of the sheet S during the acceleration period (points in time t2 to t3) where the sheet S is accelerated.

Third Embodiment

In the embodiments described above, no particular consideration is given to the type of sheet S, and the operations carried out have been such that the tension Tb being applied to the sheet S is set to the pre-tension F1 and thereafter is switched to the tension F2. However, it would also be possible to configure such that the mode of setting the tension Tb of the sheet S is varied in accordance with the type of sheet S. As specific examples, the configuration can be as is illustrated below in the third embodiment. The point of difference in the third embodiment from the embodiments described above is primarily that the mode of setting the tension Tb of the sheet S is varied in accordance with the type of sheet S, and thus the description below shall center on this different portion; a description of like portions shall be omitted as appropriate. It shall be readily understood that the third embodiment, too, being equipped with a configuration akin to that of the embodiments described above, thereby gives rise to an effect similar to that of the first embodiment.

Figure 8:
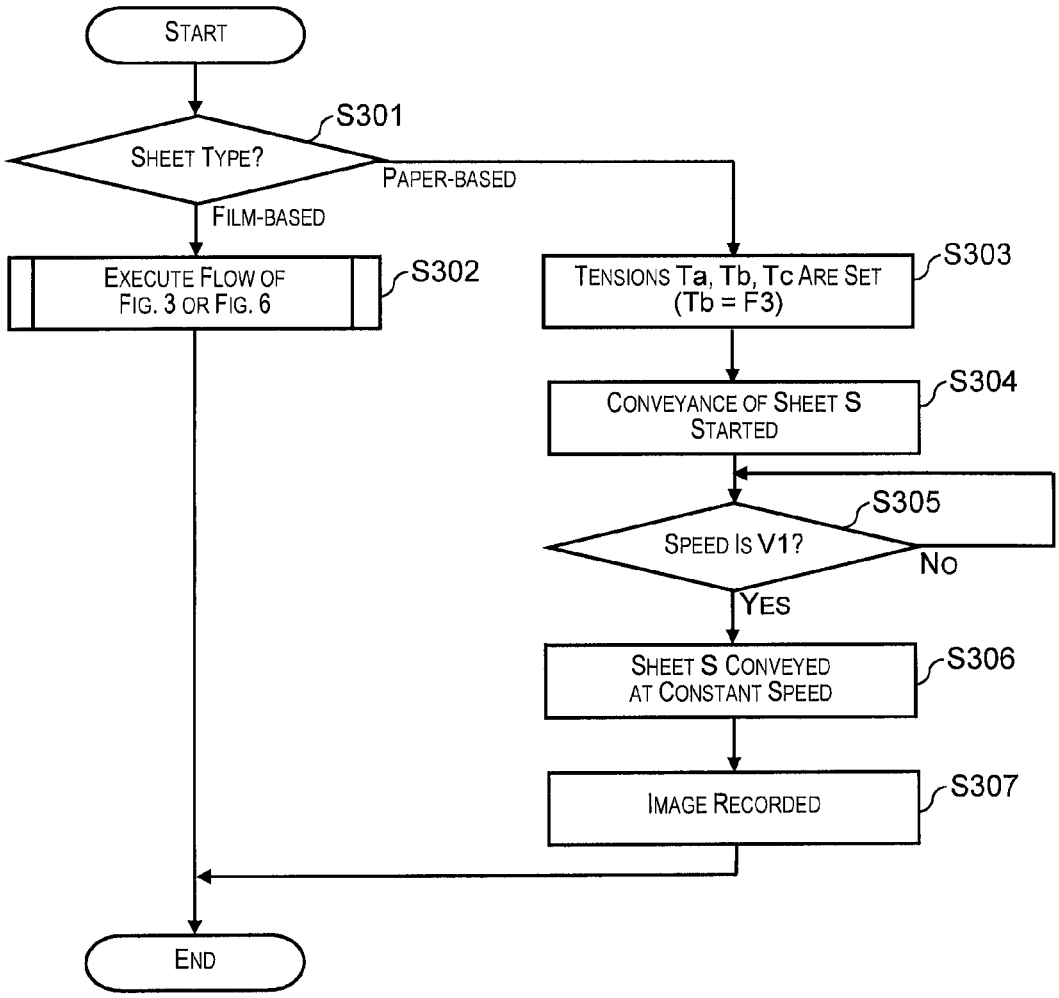
FIG. 8 is a flow chart illustrating an operation executed by a printer of a third embodiment.
Figure 9:
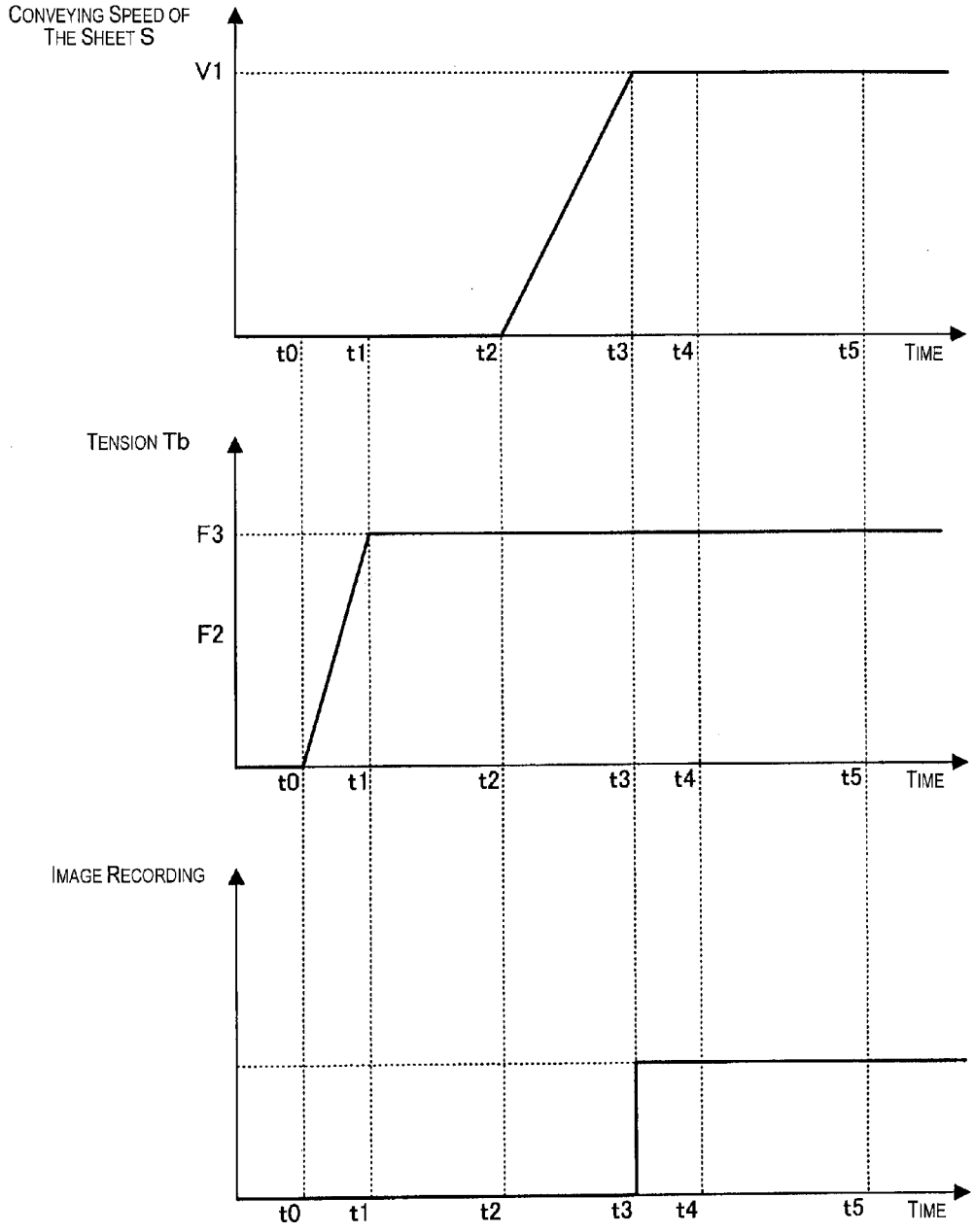
FIG. 9 is a timing chart illustrating an operation executed by the printer of the third embodiment.

FIG. 8 is a flow chart illustrating a summary of an operation executed by a printer as in the third embodiment. FIG. 9 is a timing chart illustrating a summary of an operation executed by the printer as in the third embodiment. When a command indicating that image recording is to be started is received from the host computer 10, the printer control unit 200 executes the flow chart in FIG. 8. The flow chart is read out from the program 124, and is stored in advance in a memory inside the printer control unit 200 or elsewhere.

In a step S301, a distinction is made between whether the type of sheet S is film-based or paper-based. In a case where the type of sheet S is film-based, the flow proceeds to a step S302, and the flow chart in FIG. 3 or the flow chart in FIG. 6 is executed. In other words, the conveyance of the sheet S is started in a state where the higher pre-tension F1 has been applied to the sheet S, but the tension Tb to be applied to the sheet S after the conveyance of the sheet S has been started is switched to the lower tension F2. Accordingly, it becomes possible to cause the rotation of the platen drum 30 to initiate promptly at the start of the conveyance of the sheet S, and to curtail the period of time where the rotation of the platen drum 30 has poor performance in terms of following the conveyance of the sheet S.

On the other hand, in a case where the type of sheet S is paper-based, steps S303 to S307 are executed. In the step S303, the torques of the supply motor M20, the rear drive motor M32, and the take-up motor M40 are adjusted, and the respective tensions Ta, Tb, Tc of the sheet S at the supply unit 2, the process unit 3, and the take-up unit 4 are set to initial values. At this time, the tension Tb of the process unit 3 is switched to a pre-tension F3 that is greater than the tension F2 (F3>F2), over a predetermined period of time (=t1−t0). In a subsequent step S304, the front drive motor M31 is operated, whereby the front drive roller 31 starts to rotate and the conveyance of the sheet S is started. The conveying speed of the sheet S is thereby accelerated (at points in time t2 to t3 in FIG. 9).

In a step S303, a determination is made as to whether or not the conveying speed of the sheet S has reached the speed V1. When the conveying speed of the sheet S has reached the speed V1 (a case of "YES" in the step S305), then the flow proceeds to the step S306, in which the conveying speed of the sheet S is fixed to the speed V1, and the sheet S is conveyed at constant speed (point in time t3 in FIG. 9 and thereinafter). Also, when the conveying speed of the sheet S has reached the speed V1 and becomes a constant speed, the reduction of the tension Tb of the sheet S at the process unit 3 is started in the step S307. As illustrated in FIG. 9, in the present embodiment, in the case where the type of sheet S is paper-based, the switching operation for the tension Tb of the sheet S is not carried out even after the conveyance of the sheet S has been started, but rather the tension Tb being applied to the sheet S is maintained at the tension F3, and the recording of the image is executed in this state.

As in the description above, in the present embodiment, in the case where the sheet S is film-based, then the switching operation for switching the tension Tb of the sheet S to the lower tension F2 from the pre-tension F1 is executed. In other words, a film-based sheet S has the property of being easily stretched by the tension Tb. As such, preferably, as has been described above, the period where the higher tension F1 is being applied is restricted to being close to the start of the conveyance of the sheet S, and then after the start of conveyance, the tension Tb being applied to the sheet S is kept low.

On the other hand, a paper-based sheet S is less easily stretched by the tension Tb. In view whereof, in the present embodiment, in the case where the type of sheet S is paper-based, there is no limitation to being close to the start of the conveyance of the sheet S, but rather the pre-tension F3 is applied in a continuous manner. Specifically, the conveyance of the sheet S is started in a state where the pre-tension F3 that is higher than the tension F2 is applied to the sheet S, and the switching operation is not executed even after the conveyance of the sheet S has been started, but rather the tension Tb being applied to the sheet S is maintained at the pre-tension F3. In this case, too, because the higher pre-tension F3 is being applied to the sheet S at the start of conveyance of the sheet S, a considerable force of friction in accordance with the pre-tension F3 will act between the sheet S and the platen drum 30. Accordingly, it becomes possible to cause the rotation of the drum 30 to initiate promptly at the start of the conveyance of the sheet S, and to curtail the period of time where the rotation of the drum 30 has poor performance in terms of following the conveyance of the sheet S.

Other

As in the foregoing, in the embodiments described above, the printer 1 is equivalent to the "image recording device" of the present invention; the sheet S is equivalent to the "recording medium" of the present invention; the platen drum 30 is equivalent to the "drum" of the present invention; the recording heads 51 are equivalent to the "recording unit" of the present invention; and the front drive roller 31, the rear drive roller 32, the front drive motor M31, the rear drive motor M32, and the printer control unit 200 function in collaboration as the "conveyor unit" of the present invention. The pre-tension F1 is equivalent to the "first tension" of the present invention; the tension F2 is equivalent to the "second tension" of the present invention; and the pre-tension F3 is equivalent to the "third tension" of the present invention. The drum encoder E30 is equivalent to the "rotation detector" of the present invention, and the tension sensor S34 is equivalent to the "tension detector" of the present invention.

The invention is not to be limited to the embodiments described above; rather, a variety of different modifications can be added to what has been described above, provided that there is no departure from the spirit of the present invention. For example, in the first embodiment, the reduction of the tension Tb was started at a point in time t4, at a wait of a predetermined period of time after the point in time t3 where the conveying speed of the sheet S had reached the speed V1. However, the reduction of the tension Tb can also be started at the point in time t3 where the conveying speed of the sheet S has reached the speed V1.

Alternatively, the timing for the start of the reduction of the tension Tb can not be determined on the basis of the conveying speed of the sheet S but rather can be determined on the basis of the circumferential speed of the platen drum 30. As a specific example, similarly with respect to the step S108 in FIG. 3, a determination can be made as to whether or not the circumferential speed of the platen drum 30 matches the conveying speed of the sheet S, on the basis of the output of the drum encoder E30, and the reduction of the tension Tb of the sheet S can be started after the point in time where there is a match.

Also, in the embodiments described above, the recording of the image was started after the conveying speed of the sheet S had reached the constant speed V1. However, the timing for the start of the image recording can not be determined on the basis of the conveying speed of the sheet S, but rather can be determined on the basis of the tension Tb of the sheet S. As a specific example, the configuration can be such that the image recording is started after the point in time where the tension Tb of the sheet S has reached the tension F2. Alternatively, the image recording can be started during the acceleration period of the sheet S (the points in time t2 to t3).

Also, in the embodiments described above, the switching operation for switching the tension Tb of the sheet S to the tension F2 was executed by monotonically reducing the tension Tb in a linear manner with respect to the passage of time. However, the switching operation can also be executed by changing the tension Tb in a mode different from this.

Also, in the embodiments described above, the speed control was executed with respect to the front drive roller 31, and the torque control was executed with respect to the rear drive roller 32. However, the speed control can also be executed with respect to the rear drive roller 32, the conveying speed of the sheet S being determined from the rear drive roller 32, and the torque control can be executed with respect to the front drive roller 31, the tension Tb of the sheet S being adjusted by the front drive roller 31. The configuration can also herein be such that the sensor for detecting the tension Tb of the sheet S is provided to the driven roller 33.

What is claimed is:

1. An image recording device, comprising:

a conveyor unit programmed to convey a recording medium;

a drum rotatable under force of friction against the recording medium being conveyed by the conveyor unit, the recording medium being wound around the drum;

a recording unit programmed to record an image onto a portion of the recording medium being conveyed by the conveyor unit, with the portion of the recording medium being wound around the drum; and a controller programmed to control the conveyor unit such that the conveyor unit starts the conveyance of the recording medium in a state where a first tension has been applied to the recording medium, the controller being further programmed to control the conveyor unit such that the conveyor unit executes a modification operation for modifying the tension applied to the recording medium after the conveyance of the recording medium has been started, to a second tension that is lower than the first tension, the controller being further programmed to control the conveyor unit such that the conveyor unit accelerates a conveying speed of the recording medium during an acceleration period after the start of conveyance and thereafter maintains the conveying speed at a constant speed while the second tension is applied to the recording medium.

2. The image recording device according to claim 1, wherein the controller is further programmed to control the conveyor unit such that the conveyor unit executes the modification operation such that the tension applied to the recording medium becomes the second tension after a point in time where the conveying speed of the recording medium has become a constant speed.

3. The image recording device according to claim 2, wherein the controller is further programmed to control the conveyor unit such that the conveyor unit executes the modification operation by gradually reducing the tension applied to the recording medium from the first tension to the second tension.

4. The image recording device according to claim 3, wherein the controller is further programmed to control the conveyor unit such that the conveyor unit starts the reduction of the tension applied to the recording medium, during the acceleration period.

5. The image recording device according to claim 3, wherein the controller is further programmed to control the conveyor unit such that the conveyor unit, during the acceleration period, maintains the tension applied to the recording medium at the first tension, and then starts the reduction of the tension applied to the recording medium after the point in time where the conveying speed of the recording medium has become a constant speed.

6. The image recording device according to claim 1, wherein the recording unit is further programmed to start the recording of the image during the acceleration period.

7. The image recording device according to claim 1, wherein the recording unit is further programmed to start the recording of the image after the point in time where the conveying speed of the recording medium has become a constant speed.

8. The image recording device according to claim 1, wherein the recording unit is further programmed to start the recording of the image after the point in time where the tension applied to the recording medium by the conveyor unit has become the second tension.

9. The image recording device according to claim 1, further comprising a rotation detector programmed to detect the rotation of the drum.

10. The image recording device according to claim 9, wherein the recording unit is further programmed to adjust the timing for executing the recording of the image on the recording medium, on the basis of a detection result from the rotation detector.

11. The image recording device according to claim 9, wherein the controller is further programmed to control the conveyor unit such that the conveyor unit adjusts the timing where the tension being applied to the recording medium is modified to the second tension, on the basis of the detection result from the rotation detector.

12. The image recording device according to claim 1, wherein the controller is further programmed to control the conveyor unit such that the conveyor unit executes the modification operation in a case where the recording medium is film-based.

13. The image recording device according to claim 12, wherein in a case where the recording medium is paper-based, the controller is further programmed to control the conveyor unit such that the conveyor unit starts the conveyance of the recording medium in a state where a third tension that is higher than the second tension is applied to the recording medium, and then does not carry out the modification operation even after the conveyance of the recording medium has been started, but rather maintains the tension being applied to the recording medium at the third tension.

14. The image recording device according to claim 1, wherein the conveyor unit has a tension detector for detecting the tension of the recording medium, and adjusts the tension being applied to the recording medium in accordance with a detection result from the tension detector.

15. An image recording method in which a recording medium is conveyed, and an image is recorded onto a portion of the recording medium being conveyed, with the portion of the recording medium being wound around a drum that rotates under force of friction against the recording medium, the image recording method comprising:

starting the conveyance of the recording medium in a state where a first tension has been applied to the recording medium;

modifying the tension applied to the recording medium after the conveyance of the recording medium has been started, to a second tension that is lower than the first tension; and accelerating a conveying speed of the recording medium during an acceleration period after the start of conveyance and thereafter maintaining the conveying speed at a constant speed while the second tension is applied to the recording medium.

* * * * *